US010597051B2

(12) United States Patent
Coseglia

(10) Patent No.: US 10,597,051 B2
(45) Date of Patent: Mar. 24, 2020

(54) RAILWAY CAR TRUCK FRICTION SHOE

(71) Applicant: Amsted Rail Company, Inc., Chicago, IL (US)

(72) Inventor: John Coseglia, Edwardsville, IL (US)

(73) Assignee: Amsted Rail Company, Inc., Chicago, IL (US)

( * ) Notice: Subject to any disclaimer, the term of this patent is extended or adjusted under 35 U.S.C. 154(b) by 172 days.

(21) Appl. No.: 15/453,489

(22) Filed: Mar. 8, 2017

(65) Prior Publication Data

US 2018/0257675 A1 Sep. 13, 2018

(51) Int. Cl.

| | |
|---|---|
| ***B61F 5/12*** | (2006.01) |
| ***B61F 3/02*** | (2006.01) |
| ***B61F 5/06*** | (2006.01) |
| ***B61F 5/24*** | (2006.01) |

(52) U.S. Cl.

CPC ..... *B61F 5/122* (2013.01); *B61F 3/02* (2013.01); *B61F 5/06* (2013.01); *B61F 5/24* (2013.01)

(58) Field of Classification Search

CPC ..... B61F 3/02; B61F 5/06; B61F 5/12; B61F 5/122; B61F 5/24; B61F 5/04

See application file for complete search history.

(56) References Cited

U.S. PATENT DOCUMENTS

| | | | | |
|---|---|---|---|---|
| 4,109,585 | A * | 8/1978 | Brose | B61F 5/122 105/198.4 |
| 4,256,041 | A | 3/1981 | Kemper et al. | |
| 4,274,340 | A | 6/1981 | Neumann et al. | |
| 4,825,775 | A * | 5/1989 | Stein | B61F 5/122 105/198.5 |
| 5,511,489 | A * | 4/1996 | Bullock | B61F 5/122 105/198.2 |
| 5,850,795 | A * | 12/1998 | Taillon | B61F 5/06 105/198.2 |
| 6,425,334 | B1 | 7/2002 | Wronkiewicz | |
| 8,104,409 | B2 | 1/2012 | Wolinski | |
| 2002/0073880 | A1* | 6/2002 | Wronkiewicz | B61F 5/122 105/182.1 |

FOREIGN PATENT DOCUMENTS

| | | |
|---|---|---|
| CN | 1220218 A | 6/1999 |
| CN | 1070791 C | 9/2001 |
| SU | 141499 | 1/1961 |
| WO | WO 2005/005219 | 1/2005 |
| WO | WO 2011/019579 | 2/2011 |

OTHER PUBLICATIONS

U.S. Appl. No. 15/453,546, filed Mar. 8, 2017 (Year: 2017).*
U.S. Appl. No. 15/453,515, filed Mar. 8, 2017 (Year: 2017).*

* cited by examiner

*Primary Examiner* — Mark T Le
(74) *Attorney, Agent, or Firm* — Joseph M. Butscher; The Small Patent Law Group, LLC

(57) ABSTRACT

A railway truck includes two parallel side frames, a suspension spring assembly supported by the side frames, and a bolster transversely mounted between the side frames and supported by the suspension spring assembly. Each side frame has at least one vertical support face, and the bolster has at least one sloped support face. A friction shoe includes a bottom base engaging and supported by a support spring, and a sloped wall engaging the sloped support face of the bolster. The friction shoe prevents bolster side wall wear.

19 Claims, 4 Drawing Sheets

RAILWAY CAR TRUCK FRICTION SHOE

BACKGROUND AND SUMMARY OF THE INVENTION

The invention relates generally to railway car truck friction damping arrangements, and more particularly to a railway car truck friction shoe.

The present invention is directed to a friction wedge or shoe for a railroad car truck and in particular to a friction shoe including a body having a sloped face and a vertical face. The friction shoe dissipates energy throughout the range of suspension travel and compensates for wear over years of use.

Railroad car trucks of a design known as a three piece railway car truck include a pair of spaced apart side frames and a bolster that extends transversely between the side frames. The bolster is resiliently supported at each end on a respective side frame by a plurality of suspension springs. Wedge shaped friction shoes are used in such railroad car trucks to dampen movement of the bolster with respect to the side frame of the railroad car truck. Friction shoes are usually generally triangular wedge shaped such that two laterally spaced sloped faces are each in contact with one of two laterally spaced sloped faces of the bolster. The friction shoe is also comprised of a vertical face that is in contact with a corresponding wear plate mounted on a vertical face of a side frame column. Accordingly, the friction shoe acts as a motion damping wedge between the bolster and the wear plate on a vertical column of the side frame.

The wear plate on the vertical column of the side frame is usually comprised of steel. The friction shoe is wedged into engagement between the sloped faces of the bolster and the vertical column of the side frame by a suspension spring. Resistance to sliding movement of the friction shoe with respect to the side frame, which in turn provides dampening of vertical bolster movement, is provided by the frictional forces generated between the friction shoe vertical face and a wear plate on the side frame vertical column. The wedge shape of the friction shoe and the springs that force the friction shoe upward between the vertical column of the side frame and the sloped faces of the bolster provides automatic compensation for wear in the system. As the friction shoe, bolster, and side frame column wear with use over time the spring forces the friction shoe into the increasingly available space. As a result, the friction shoe automatically compensates for wear and rises relative to the bolster as the system wears.

In normal operation the friction shoes also move laterally in the friction shoe pockets in the bolster and wear against the side wall of the pocket. The foundry process used to make the hollow friction shoe generally utilizes holes in the triangular side walls to support the part of the mold that creates the hollow inside of the friction shoe. As the friction shoe wears against the side walls of the bolster friction shoe pocket the holes leave "islands" of unworn material which can interfere with or prevent the friction shoe from rising to take up wear in the bolster slope surfaces and side frame column surfaces.

It is an object of the present invention to provide an improved railway car truck friction shoe wherein the friction shoe and bolster can have a longer wear life and the friction shoe will not get stuck in the bolster.

BRIEF DESCRIPTION OF THE DRAWING FIGURES

DETAILED DESCRIPTION OF THE PREFERRED EMBODIMENT

Figure 1:
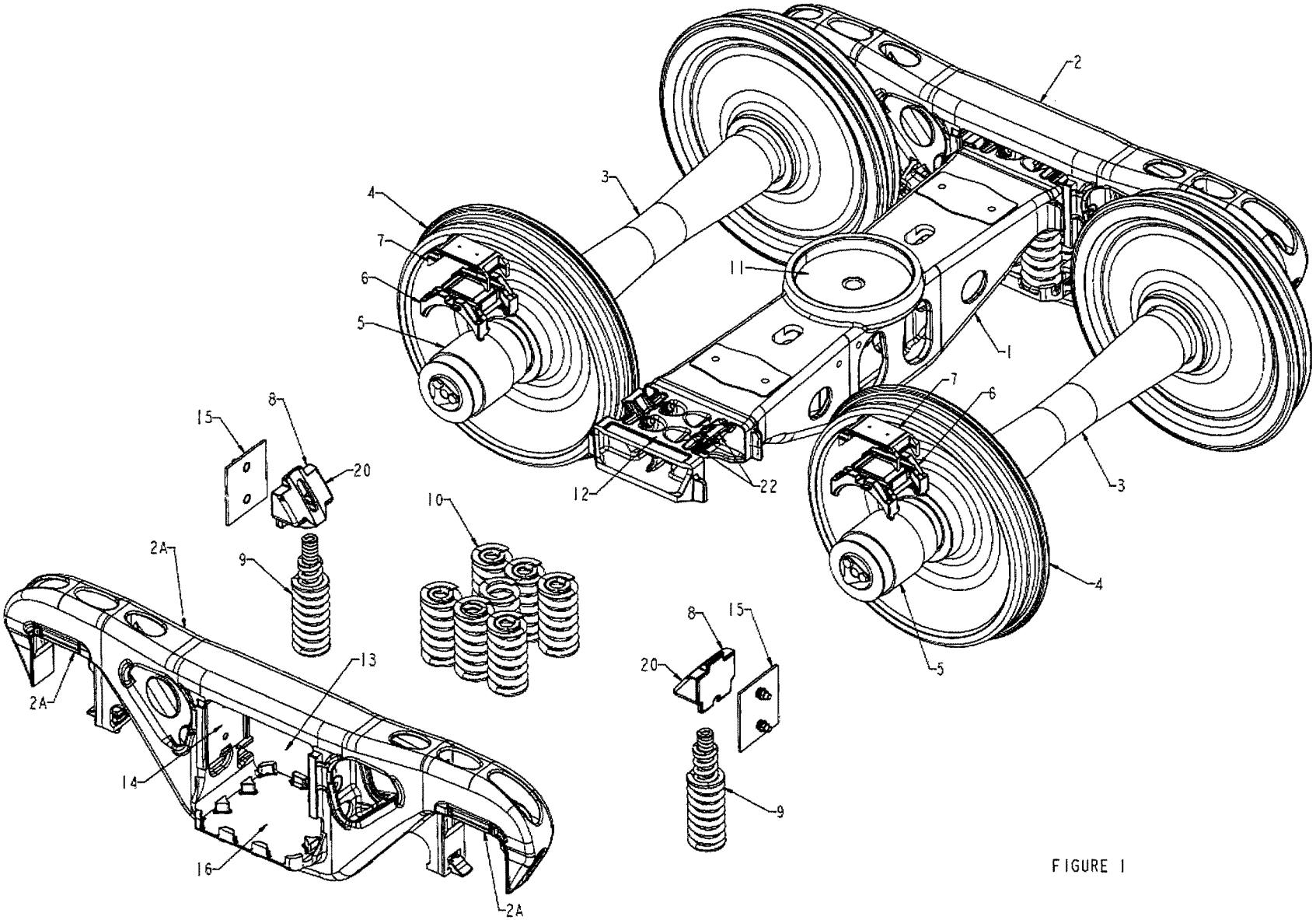
FIG. 1 is an exploded isometric view of a railway car truck in accordance with an embodiment of the present invention.

Referring now to FIG. 1, a friction wedge 8 of the present invention is shown in a railroad car truck. The railway car truck includes two side frames 2 which are spaced apart and generally parallel to one another. Each side frame 2 includes a bolster opening 13 formed by a pair of spaced apart vertical columns 14. A planar wear plate 15 is connected to the interior surface of each column 14. The railway car truck also includes a bolster 1 which extends generally transversely between the side frames 2. Each end 12 of the bolster 1 is located within a respective bolster opening 13 and is vertically supported on a side frame 2 by a plurality of helical coil suspension springs 10. Suspension springs 10 are themselves supported on a spring support section 16 of each side frame 2. Suspension springs 10 are resiliently compressible to thereby allow the ends of the bolster 1 to move vertically upwardly and downwardly within the windows 13 and with respect to the side frames 2. Each bolster end 12 includes a plurality of sloped walls 22. Each sloped wall 22 is adapted to engage a sloped surface 20 of a respective friction shoe 8. Friction shoe 8 is seen to be supported by suspension control springs 9 to provide a damping force to the vertical motion of bolster 1 while supported on suspension springs 10 as the railway car travels on the rails.

Railway wheels 4 are mounted on axles 3. Axle bearings 5 are mounted on the ends of axles 3. Bearings spacer 6 and pad 7 are provided to receive axle bearings in side frame pedestal openings 2A. Center bowl 11 on the top surface of bolster 1 is provided to help support the railway freight car on the truck.

Figure 2:
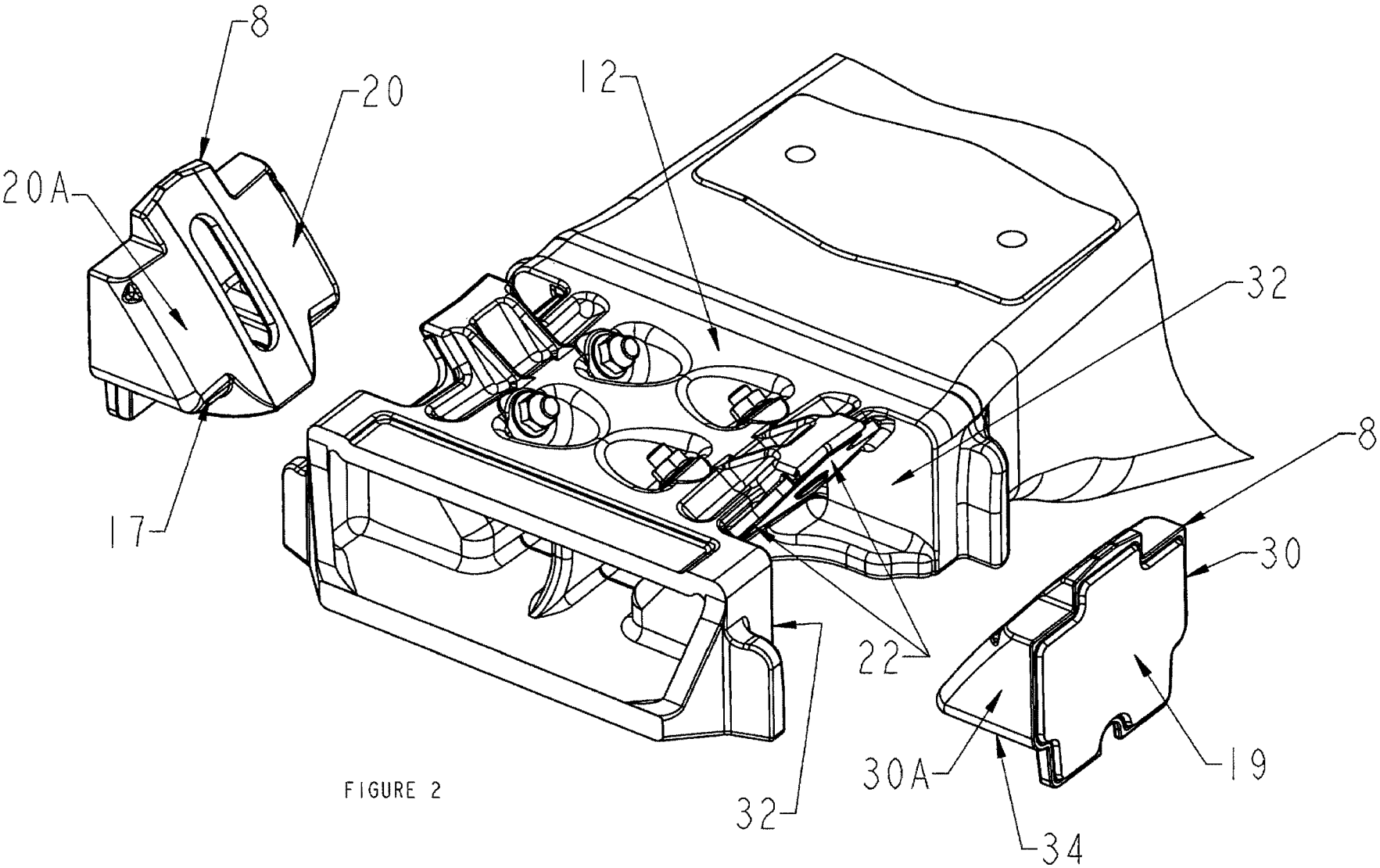
FIG. 2 is a detailed partial isometric view of a portion of a railway car truck in accordance with an embodiment of the present invention.
Figure 4:
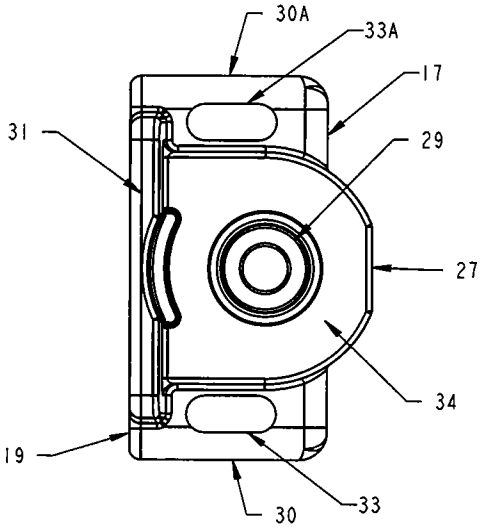
FIG. 4 is a bottom view of a friction shoe in accordance with an embodiment of the present invention.
Figure 3:
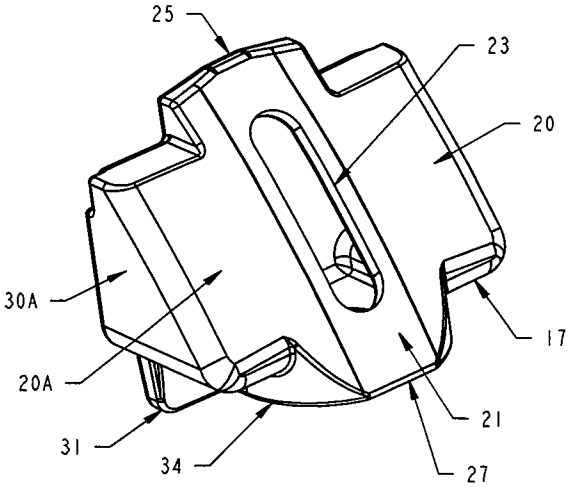
FIG. 3 is a isometric view of a friction shoe in accordance with an embodiment of the present invention.
Figure 6:
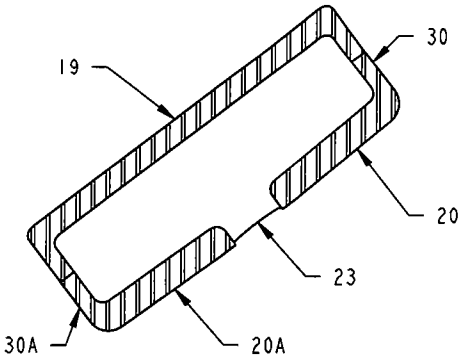
FIG. 6 is a section view of the shoe in accordance with an embodiment of the present invention.
Figure 5:
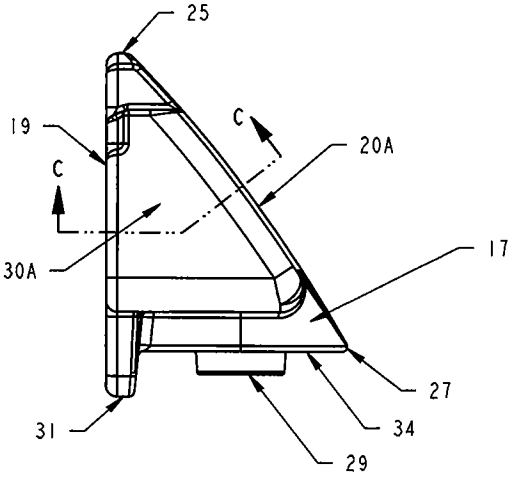
FIG. 5 is a side view of a friction shoe in accordance with an embodiment of the present invention.

As best shown in FIG. 2, friction shoe 8 includes a body 17. The body 17 is generally triangular or wedge-shaped and is generally 5 to 10 inches wide. Extending downward from the center of the body 17 includes a base having a generally horizontal bottom wall 34. The bottom base surface 34 is adapted to engage the top end of a set of suspension control springs 9. The body 17 also includes a generally vertical front wall includes a front face 19. The body 17 also includes laterally spaced sloped walls 20 and 20A that extend at an inclined angle of approximately thirty-five to degrees between the base 34 and front face 19. Sloped walls 20 and 20A are each adapted to engage the inclined walls 22 of the bolster 1. The friction shoe 8 is constrained laterally within the bolster end 12 by the bolster friction shoe pocket side walls 32 and the generally triangular side walls 30 and 30A of the shoe.

As best shown in FIGS. 3, 4, 5, and 6 the front face 19 of friction shoe body 17 has an extension 31 that protrudes approximately 1 inch below the bottom base surface 34. Front face 19 of friction shoe body 17 is in direct contact with and extends from an intersection with top edge 25 of sloped surface 20 and 20A and center spacing section 21. Center spacing section 21 extends between laterally spaced sloped walls 20 and 20A. Center spacing section 21 may include an opening 23 that extends from near the top edge 25 of friction shoe body 17 to near intersection 27 between bottom base surface 34 and center spacing section 21. Center spacing section 21 may be recessed from sloped surfaces 20 and 20A. The body 17 of the friction shoe 8 may be made from metals such as steel or iron. The spaced slope surfaces 20 and 20A of the shoe are angled at 150 to 178 degrees, and preferably 174 to 176 degrees, relative to each other and ensures that the friction shoe is returned to the center of the pocket instead of constantly wearing on the bolster friction shoe pocket side wall 32. In addition to this, the generally triangular side walls of the shoe 30 and 30A have no holes. This ensures that the friction shoe wear on the bolster friction shoe pocket side walls 32 will not leave unworn protrusions that can interfere with the friction shoe's ability to move up relative to the bolster as the friction shoe vertical face 19, side frame column wear plate 15, bolster sloped surfaces 22, and friction shoe sloped surfaces 20 and 20A wear over time in normal operation. The unique geometric design of this friction shoe allows the manufacturing core support holes 33 and 33A to be moved to the non-wearing surfaces on the bottom of the friction shoe body 17. Friction shoe body 17 is typically comprised of cast iron or cast steel. The damping force by the friction shoe 8 can vary as may be selected from the various materials for friction shoe body 17 and the degree front face 19 is impinged against side frame column wear plate 15. Such damping forces can vary from 700 to 16,250 pounds with a velocity range of movement of the friction shoe vertical face 19 along the side frame column wear plate 15 of between 0 and 19 inches per second. Normal force to vertical face 19 can vary from 2000 to 12,000 pounds.

What is claimed is:

1. A railway car truck comprising:

two parallel side frames;

a suspension spring assembly supported by the side frames;

a bolster transversely mounted between the side frames and supported by the suspension spring assembly, each side frame having at least one vertical support face, the bolster having at least one sloped support face; and a friction shoe comprising:

a bottom base engaging and supported by a support spring;

two sloped walls engaging the at least one sloped support face of the bolster, wherein the two sloped walls are angled between 150 to 178 degrees relative to each other;

a sloped center spacing section between the two sloped walls, wherein the sloped center spacing section separates the two sloped walls, wherein the sloped center spacing section extends above and below heights of each of the two sloped walls, and wherein the sloped center spacing section is recessed in relation to the two sloped walls; and a vertical wall engaging a vertical support face of one of the two parallel side frames.

2. The friction shoe of claim 1, wherein the friction shoe further includes side support walls having no holes.

3. The friction shoe of claim 1, wherein the friction shoe provides a damping force between 7500 and 12,000 pounds when the friction shoe is moving at a velocity of between 0 and 19 inches per second.

4. The friction shoe of claim 1, wherein the friction shoe provides a normal force of between 2000 and 12,000 pounds.

5. The friction shoe of claim 1, wherein the center spacing section does not engage the bolster.

6. The friction shoe of claim 1, wherein the friction shoe is comprised of cast iron.

7. The friction shoe of claim 1, wherein the friction shoe is comprised of cast steel.

8. The friction shoe of claim 1, wherein the two sloped walls extend to and directly contact the bottom base.

9. A railway car truck comprising:

two parallel side frames;

a suspension spring assembly supported by the side frames;

a bolster transversely mounted between the side frames and supported by the suspension spring assembly, each side frame having at least one vertical support face, the bolster having at least one sloped support face; and a friction shoe comprising:

a bottom base engaging and supported by a support spring;

two sloped walls engaging the at least one sloped support face of the bolster, wherein the two sloped walls are angled at 150 to 178 degrees relative to each other engaging the sloped support faces of the bolster;

a sloped center spacing section between the two sloped walls, wherein the sloped center spacing section separates the two sloped walls, wherein the sloped center spacing section extends above and below heights of each of the two sloped walls, and wherein the sloped center spacing section is recessed in relation to the two sloped walls; and side support walls having no holes;

a vertical wall engaging a vertical support face of one of the two parallel side frames, the friction shoe providing a damping force of between 700 and 10,000 pounds.

10. The friction shoe of claim 9, wherein the friction shoe provides a damping force between 7500 and 10,000 pounds when the friction shoe is moving at a velocity of between 0 and 19 inches per second.

11. The friction shoe of claim 9, wherein the friction shoe provides a normal force of between 2000 and 12,000 pounds.

12. The friction shoe of claim 9, wherein the friction shoe is comprised of cast iron.

13. The friction shoe of claim 9, wherein the friction shoe is comprised of cast steel.

14. The friction shoe of claim 9, wherein the two sloped walls extend to direct contact with the bottom base.

15. A friction shoe for a railway car truck, the friction shoe comprising:

a bottom base engaging and supported by a support spring;

two sloped walls configured to engage sloped support surfaces of a bolster, wherein the two sloped walls are angled between 150 to 178 degrees relative to each other;

a sloped center spacing section between the two sloped walls, wherein the sloped center spacing section separates the two sloped walls, wherein the sloped center spacing section extends above and below heights of each of the two sloped walls, and wherein the sloped center spacing section is recessed in relation to the two sloped walls; and a vertical wall configured to engage a vertical support face of a side frame.

16. The friction shoe of claim 15, further comprising side support walls devoid of holes.

17. The friction shoe of claim 1, wherein the two sloped walls have a first slope, and the sloped center spacing section has a second slope that is the same as the first slope.

18. The friction shoe of claim 9, wherein the two sloped walls have a first slope, and the sloped center spacing section has a second slope that is the same as the first slope.

19. The friction shoe of claim 15, wherein the two sloped walls have a first slope, and the sloped center spacing section has a second slope that is the same as the first slope.

* * * * *